US009087423B2

(12) United States Patent
Maekawa et al.

(10) Patent No.: US 9,087,423 B2
(45) Date of Patent: Jul. 21, 2015

(54) MEDIUM VALIDATING APPARATUS

(75) Inventors: Kinya Maekawa, Gunma (JP); Hiroaki Higuchi, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/123,164

(22) PCT Filed: Jun. 12, 2012

(86) PCT No.: PCT/JP2012/064959

§ 371 (c)(1),
(2), (4) Date: Nov. 29, 2013

(87) PCT Pub. No.: WO2013/042407

PCT Pub. Date: Mar. 28, 2013

(65) Prior Publication Data

US 2014/0116840 A1 May 1, 2014

(30) Foreign Application Priority Data

Sep. 22, 2011 (JP) ..... 2011-207805

(51) Int. Cl.

| | |
|---|---|
| ***G07D 7/04*** | (2006.01) |
| ***G07D 7/12*** | (2006.01) |
| ***G07D 7/16*** | (2006.01) |
| *G07D 11/00* | (2006.01) |

(52) U.S. Cl.

CPC .. *G07D 7/04* (2013.01); *G07D 7/12* (2013.01); *G07D 7/164* (2013.01); *G07D 11/0021* (2013.01)

(58) Field of Classification Search

CPC ..... G07D 7/04; G07D 11/0021

USPC ..... 194/213, 320; 235/379; 209/534; 324/200

See application file for complete search history.

(56) References Cited

U.S. PATENT DOCUMENTS

| | | | | |
|---|---|---|---|---|
| 4,584,529 | A * | 4/1986 | Aoyama | 324/261 |
| 5,605,401 | A * | 2/1997 | Kondo et al. | 384/492 |
| 5,720,376 | A * | 2/1998 | Polidoro et al. | 194/207 |
| 6,782,986 | B2 * | 8/2004 | Toda et al. | 194/206 |

(Continued)

FOREIGN PATENT DOCUMENTS

| | | |
|---|---|---|
| JP | H06-87275 B2 | 11/1994 |
| JP | H11-304896 A | 11/1999 |

(Continued)

OTHER PUBLICATIONS

Foreign Decision of Grant with an English translation, 2013156683 (18 pages) Mar. 30, 2015.

*Primary Examiner* — Mark Beauchaine
(74) *Attorney, Agent, or Firm* — Rabin & Berdo, P.C.

(57) ABSTRACT

A bill validator of an automated teller machine includes a magnetic detector for detecting magnetism of bills. The magnetic detector has pressing members of resin material having bearings bored therein. The bearings rotatably hold a shaft for a guide roller which presses bills against the lower surface of a magnetic sensor. The guide roller rotates as bills run on a conveyance path. However, since the bearings consist of fixed parts of resin material and the shaft is formed of non-magnetic material, the rotation does not cause changes in a magnetic field. Thus, when the guide roller rotates, the surrounding magnetic field does not change, so that, although the magnetic detector locates in the vicinity of the guide roller, the magnetic head of the magnetic sensor can well accurately sense the magnetism of bills.

13 Claims, 9 Drawing Sheets

(56) References Cited

U.S. PATENT DOCUMENTS

| | | | | |
|---|---|---|---|---|
| 8,581,578 | B2 * | 11/2013 | Momose | 324/228 |
| 2005/0150740 | A1 | 7/2005 | Finkenzeller et al. | |
| 2006/0177117 | A1 * | 8/2006 | Morisaki et al. | 382/135 |
| 2008/0149455 | A1 * | 6/2008 | Aas et al. | 194/206 |

FOREIGN PATENT DOCUMENTS

| | | | |
|---|---|---|---|
| JP | 2004-083172 | A | 3/2004 |
| JP | 2009-163336 | A | 7/2009 |
| JP | 2010-198337 | A | 9/2010 |
| RU | 2 322 695 | C2 | 4/2008 |

* cited by examiner

MEDIUM VALIDATING APPARATUS

TECHNICAL FIELD

The present invention relates to a medium validating apparatus and a medium transaction apparatus, which are applied to an automated teller machine (ATM) for putting a medium such as bills into the machine to determine authenticity of the medium and conduct a desired transaction.

BACKGROUND ART

Automated teller machines have been used in financial institutions and such like to carry out transactions with customers, e.g. transactions of depositing cash, namely bills and coins, or withdrawing cash by a customer.

A conventional automated teller machine includes a bill slot for delivering and receiving bills to and from a customer, a validator for determining the denominations and authenticity of bills deposited in the machine, a temporary holding section for temporarily holding deposited bills, and denomination-sorted cassettes for stocking bills sorted by denominations.

In the automated teller machine, when the customer inserts bills into the bill slot of the automated teller machine, the validator distinguishes the deposited bills, and the temporary holding section temporarily storing the bills, when being determined as authentic ones, whereas bills considered as being inappropriate are returned to the bill slot to give them back to the customer. Subsequently in the automated teller machine, the customer fixes the amount of money to be deposited, and the validator in turn determines again the denominations of the bills stored in the temporary holding section to store the bills in the denomination-sorted cassettes according to the denominations thus determined.

There are some types of bills of which certain part is printed with a magnetic ink. In that case, the validator detects the magnetism of the magnetic ink by means of a magnetic sensor to refer to the position and strength of the detected magnetism for determination of the denomination and authenticity of the bill. Japanese patent laid-open publication No. 2010-198337 discloses a bill validating apparatus which includes a validator having the validation function.

In an automated teller machine to which the above bill validating apparatus is applied, the validating section includes guide rollers arranged in the vicinity of a magnetic sensor for conveying bills so as to bring bills into contact with the magnetic sensor. As the guide rollers, use is often made of bearings that are ball bearings of which the substance is selected to metal, particularly magnetic substance, in light of durability, costs and the like.

However, the bearing of magnetic substance may, for instance, become magnetized during assembly work or maintenance work of the validator. In that case, as the guide rollers rotate, the bearings will cause the magnetic field therearound to change. It causes a problem that the magnetic sensor senses the changing magnetic field as noise, leading to the decrease in the accuracy of sensing the magnetism of bills.

SUMMARY OF THE INVENTION

It is an object of the present invention to provide a medium validating apparatus and a medium transaction apparatus, which can increase the accuracy of sensing the magnetism of a medium.

A medium validating apparatus of the present invention includes a magnetic detector detecting magnetism of a supplied medium, and a validation controller validating the medium on the basis of a result of magnetism detection conducted by the magnetic detector, wherein the magnetic detector includes a magnetic sensor sensing magnetism by a magnetic head, a guide roller disposed near the magnetic head to rotate while being in contact with the medium so as to convey the medium with the medium getting into contact with the magnetic head, a shaft made of non-magnetic material inserted into a rotation center of the guide roller to keep a position where the guide roller is in contact with the medium, and a bearing consisting of a non-magnetic part to rotatably support the guide roller.

A medium transaction apparatus of the present invention includes a receiving section accepting a transaction relating to a medium, a conveyance path conveying the received medium, a magnetic detector using a magnetic head to detect magnetism of the medium conveyed over the conveyance path, and a validation controller validating the medium on the basis of a result of magnetism detection conducted by the magnetic detector, wherein the magnetic detector includes a guide roller disposed near the magnetic head to rotate while being in contact with the medium so as to convey the medium with the medium getting into contact with the magnetic head, and a bearing consisting of a non-magnetic part to rotatably support the guide roller.

A medium validating apparatus of the present invention includes a magnetic detector using a magnetic head to detect magnetism from a medium, a thickness detector detecting the thickness of the medium on the basis of an amount of displacement of a thickness detection roller having magnetic material, a conveyance roller disposed between the magnetic detector and the thickness detector to rotate about a rotational axis to convey the medium, a tension roller disposed opposite to the conveyance roller across a conveyance path for the medium to rotate in response to the rotation of the conveyance roller to transmit rotational driving force of the conveyance roller to the medium, and a validation controller validating the medium on the basis of a result of magnetism detection conducted by the magnetic head, wherein the magnetic detector includes an annular guide roller disposed near the magnetic head to rotate while being in contact with the medium so as to convey the medium with the medium getting into contact with the magnetic head, and a bearing attached as ball bearing of magnetic material on the inner periphery of the guide roller to rotatably support the guide roller.

In accordance with the present invention, a medium conveyed by the conveyance roller and the tension roller is sent to a magnetic detector, of which the guide rollers bring the medium into contact with the magnetic head, while the possibility of magnetic field changes due to the rotation of guide rollers is eliminated, whereby influence of the magnetic field changes exerted on the magnetic head can efficiently be reduced.

In accordance with the present invention, the conveyance roller and the tension roller are disposed between the magnetic detector and the thickness detector, so that a cause of magnetic field changes possibly occurring due to the arrangement and operation of the thickness detector can be kept away from the magnetic detector by the thickness of the tension roller, thereby efficiently reducing the influence of the magnetic field changes on the magnetic head. As a consequence, the accuracy in sensing the magnetism of a medium can be improved.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Figure 1:
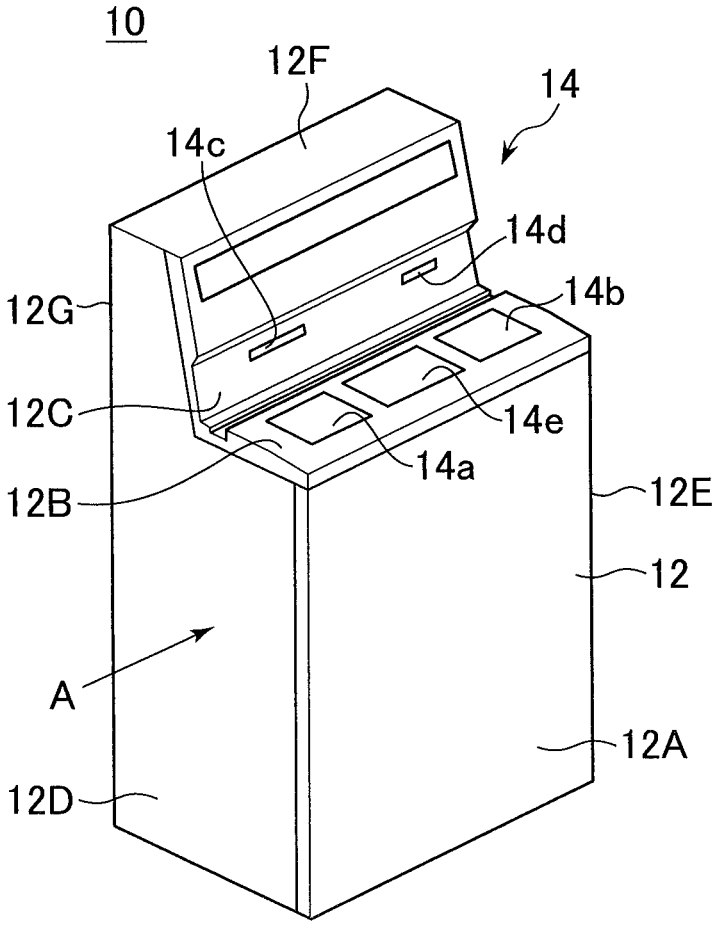
FIG. 1 is a perspective view schematically showing the appearance of an automated teller machine employing a medium validating apparatus of the present invention, seen from diagonally top left.

With reference to the accompanying drawings, an embodiment of a medium validating apparatus of the present invention will now be described in detail. FIGS. 2 and 3 to 6 will firstly be referred to describe an automated teller machine 10, particularly about its validator 16, as an embodiment of the medium validating apparatus of the invention. The automated teller machine 10 includes the validator 16 and a validation controller, not shown, and is configured to detect the magnetism of a rectangular sheet-like medium, such as bills with its portion printed with a magnetic ink, by means of a magnetic detector 30 provided in the validator 16 so as to validate bills on the basis of a result of magnetism detection. The magnetic detector 30 has a magnetic sensor 48, inside of which a magnetic head 48B is fitted. In the vicinity of the magnetic head 48B, arranged is a guide roller 52 for guiding bills, and a shaft 56 is inserted through the guide roller 52 to hold the roller rotatably. In the illustrative embodiment, the shaft 56 is particularly made of stainless steel material, which is non-magnetic substance, and bearings 54*a* and 54*b* for supporting the shaft 56 at its opposite ends are made of resin, which is also non-magnetic substance. Bills guided by the guide roller 52 near the magnetic head 48B are conveyed to pass close to the magnetic head 48B. The magnetic detector 30 with such configuration can detect the magnetism of bills by the magnetic head 48B without being affected by noise, thereby eliminating the possibility of being affected by change in the magnetic field in the prior art while the guide roller 52 rotates, and resultantly the influence of magnetic field changes on the magnetic head 48B can be reduced.

1-1. General Configuration of the Automated Teller Machine

The automated teller machine 10 has an appearance consisting of a generally box-like housing 12 and a customer service section 14, which are combined as shown in FIG. 1, and has the function of conducting cash transactions with customers.

The housing 12 is provided with a frame 12B kept in the horizontal position for allowing the customer standing in front of a front panel 12A formed on the front of the housing as a part of the customer service section 14 to insert bills and to operate a touch panel without difficulty. The frame 12B is preferably formed to have an operation plane bent at almost right angle or gently inclined with respect to the front panel 12A. The frame 12B is connected with a front panel 12C, as its front part, tilting from the backward position of the frame 12B. As the housing 12 and the customer service section 14 are formed in the above fashion, side panels 12D and 12E of the housing 12 have such a figure that an integral combination of rectangle and trapezoid. The housing 12 has its top panel 12F preferably shaped covering the side panels 12D and 12E.

In the housing 12, the panels such as the front panel 12A and a back panel 12G opposite thereto are partly formed by openable doors. More in detail, the doors are closed off prior to being served to cash transaction with the customer, in order that the housing 12 can protect bills and coins stored therein. When a serviceperson carries out a maintenance work, the doors can be opened up as necessary to thereby facilitate the maintenance work on its inside components.

The customer service section 14 has the functions of directly handling cash, a bankbook or the like for the customer and imparting information on a transaction and receiving operational instructions. The front panel 12C is provided with, as the customer service section 14, a coin slot 14*a*, a bill slot 14*b*, a bankbook slot 14*c*, a card slot 14*d* and a display console 14*e*.

The coin slot 14*a* and the bill slot 14*b* are openings common to receiving and discharging coins and bills the customer deposits and he or she withdraws. The coin slot 14*a* and the bill slot 14*b* can be opened and closed by shutters respectively provided thereto and driven in response to the user's operation.

The bankbook slot 14*c* is adapted to receive a bankbook for use in transaction and eject the bankbook when the transaction is finished. The bankbook slot 14*c* has a bankbook processing unit, not shown, on its behind for recording transaction details on the bankbook.

The card slot 14*d* is adapted to receive and eject various types of cards, such as bank cards. The card slot 14*d* has on its behind a card processing unit, not shown, for reading an account number or similar, which are magnetically or electrically recorded on the cards.

The display console 14*e* is configured with a liquid crystal display (LCD) for displaying an operation screen during transaction and a touch panel, in which integrated are touch sensor functions for selecting transaction types and inputting data, e.g. a personal identification number and a transaction amount of money.

The following description defines that the front panel 12A of the automated teller machine 10 is the front side whereas the back panel 12G is the back side, and the side panels 12D and 12E seen from the customer standing in front of the front panel 12A are the left side and the right side, respectively. Moreover, the top panel 12F is the upper side and the opposite side there to is the lower side.

Figure 2:
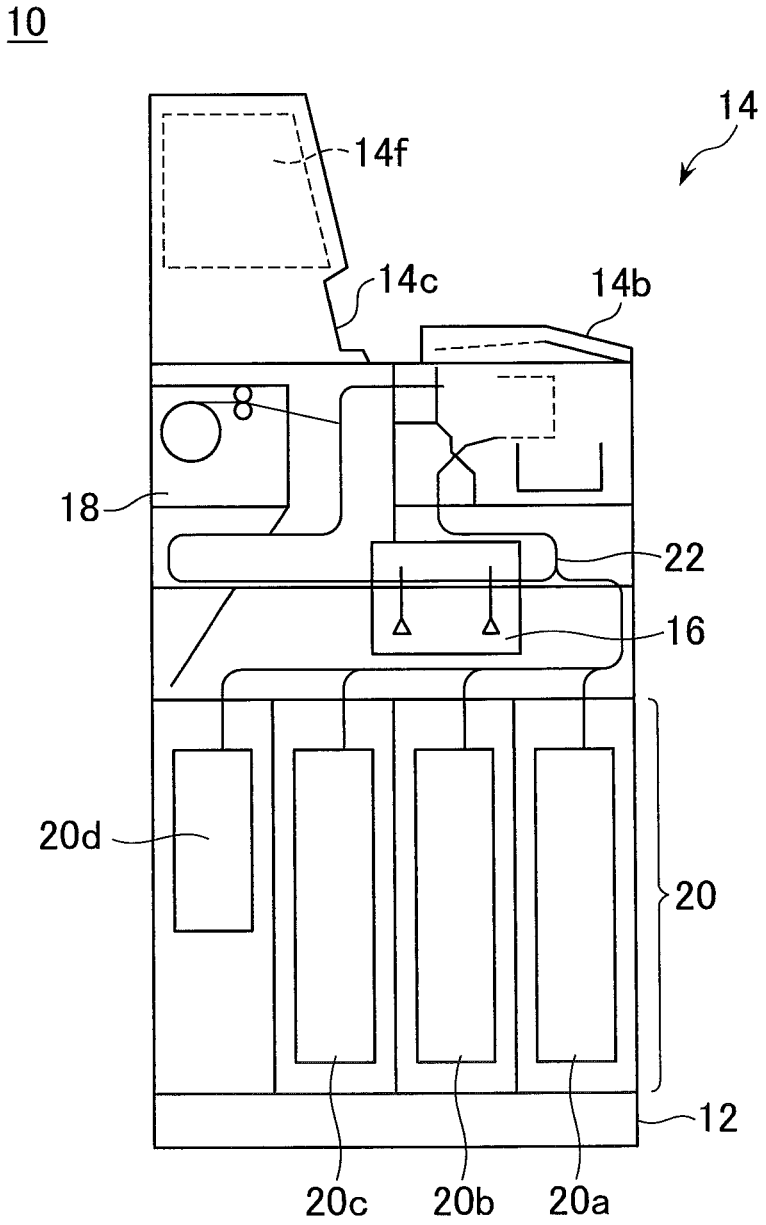
FIG. 2 is a schematic side view showing a substantial part of a box-like internal structure of the automated teller machine in FIG. 1, seen from a direction of arrow A.

FIG. 2 is a side view seen from the direction of allow A according to FIG. 1 with the side panel 12D of the automated teller machine 10 being removed, the figure presenting a part of the internal structure of the machine 10 principally pertaining to the processing of bills. As shown in the figure, the automated teller machine 10 includes the customer service section 14, a validator 16 provided inside the housing 12, a temporary holding section 18 and a bill storage 20.

The customer service section 14 is provided with, as described before, the bill slot 14*b*, bankbook slot 14*c* and a controller 14*f* marked with a dashed line, all of which are arranged on the upper part of the housing 12 for operating the automated teller machine 10. The controller 14*f* has a capability of generally controlling over the automated teller machine 10. The general control covers the meaning of shutter mechanism control, drive control of a motor and drive control of a conveyance system according to validation results.

Now, described will be an example of a transaction that the customer deposits some bills in the automated teller machine 10. The bills inserted through the bill slot 14*b* are sent on a conveyance path 22 to the validator 16, the temporary holding section 18 and the bill storage 20.

The conveyance path 22 is indicated with a thick-full line in FIG. 2. The conveyance path 22 is provided with a motor, gears, pulleys, a belt and the like, although not shown in the figure. Bills are conveyed with the shorter side thereof in parallel with a direction of movement. The motor drives the belt for conveying bills to wind-up/rewind the belt. The conveyance path 22 is provided with a solenoid for changing the conveyance direction of bills on the conveyance path 22. The automated teller machine 10 is also provided with other necessary elements, e.g. cooling fan.

The controller 14*f* receives a specific operation input on the display console 14*e*, FIG. 1, and in turn opens the shutter, not shown, of the bill slot 14*b*. Then the customer inserts bills to be deposited. The controller 14*f* sends the inserted bills over the conveyance path 22 to the validator 16 to control the validation of the bills. When the bills sent to the validator 16 are determined as authenticated, the controller 14*f* conveys the bills to the temporary holding section 18 to temporarily hold them. If a bill sent to the validator 16 is determined unauthenticated so as not to be accepted, the controller 14*f* sends the bill thus determined back to the bill slot 14*b* to return the same to the customer.

Then, the controller 14*f* prompts the customer to fix the deposit amount on the display console 14*e* to convey the bills held in the temporary holding section 18 back to the validator 16 so as to determine the denominations of the bills before conveying the bills to the bill storage 20.

The validator 16 has the function of determining denominations and authenticity of bills. The validator 16 is controlled by the controller 14*f*. Furthermore, since the above-mentioned motor, solenoid and cooling fan are components causing magnetic disturbance, the validator 16 is disposed in a place on the underside of, or separated from, them in order to reduce the magnetic influence on the validator 16.

The temporary holding section 18 has the function of temporarily holding inserted bills. The temporary holding section 18 holds the conveyed bills by taking up the belt on a drum. The bill storage 20 includes storing chambers 20*a*, 20*b*, 20*c* and 20*d* for storing bills by denomination by denomination. Bills determined by the validator 16 as being undamaged are sent to the bill storage 20. The bill storage 20 stores the bills in the storing chambers 20*a*, 20*b* and 20*c* depending on their denominations to be stacked in the direction of the bill thickness. The bill storage 20 does not store bills the validator 16 determined as damaged. Damaged bills are sent to the reject chamber 20*d*. The reject chamber 20*d* stores bills thus conveyed to be stacked in the direction of the bill thickness.

As above, the automated teller machine 10 validates bills by means of the validator 16 during the transactions for depositing and withdrawing bills, and determines, based on a validation result, where the bills to be sent and then delivers the bills to the determined places over the conveyance path 22.

1-2. Validator

Figure 3:
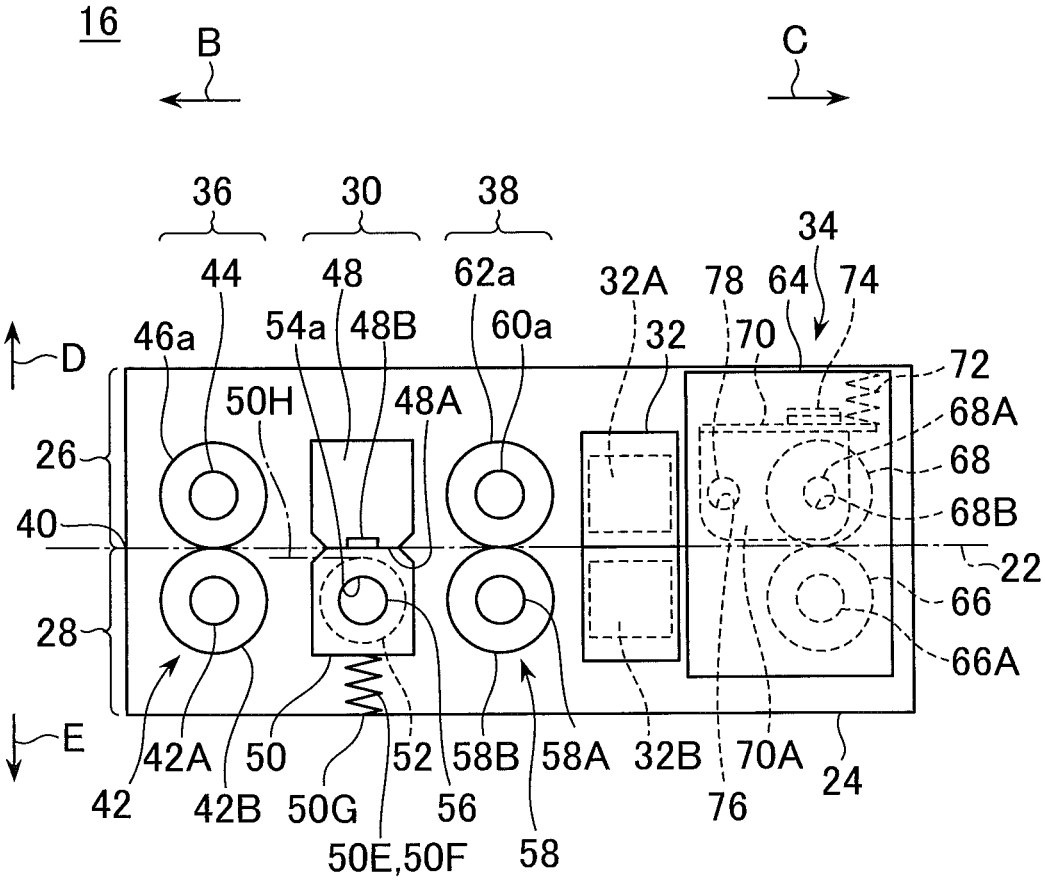
FIG. 3 is a side view of a validator shown in FIG. 2 with its left side panel removed, seen from the direction of arrow A.

In the validator 16, the conveyance path 22 is formed inside a cuboidal housing 24 between an upper unit 26 and a lower unit 28, respectively provided on the upper and lower areas of the housing, as shown in FIG. 3 with a dotted and dashed line. FIG. 3 schematically illustrates the internal structure of the validator 16 viewed from the direction of arrow A, in which a side panel, not shown, of the housing 24 is removed.

The conveyance path 22 has a belt, not shown, running in a direction of arrow B, i.e. from the front of the machine 10 to its back, or in a direction of arrow C, i.e. from the back to the front, to thereby move bills. The validator 16 validates bills under control of the controller 14*f*.

In addition, the validator 16 is also provided with the magnetic detector 30, an optical detector 32 and a thickness detector 34, arranged in this order in the housing 24 along the arrow C. The validator 16 is provided with sectional conveyance paths 36 and 38, respectively disposed between a belt input/output port 40 on the back of the validator and the magnetic detector 30 and between the magnetic detector 30 and the optical detector 32.

In the validator 16, those modules are linearly juxtaposed to each other due to the constraints of the installation layout inside the automated teller machine 10 and of the conveyance to securely deliver bills in parallel with the direction of the shorter side of bills, by way of example.

1-2-1. Arrangement of the Conveyance Paths

The sectional conveyance path 36 is provided with a conveyance roller 42, which is included in the lower unit 28 under the conveyance path 22, and a shaft 44 and a tension roller 46, which are included in the upper unit 26 above the conveyance path 22.

The conveyance roller 42 has a shaft 42A penetrating through the center of a plurality of annular rubber rollers 42B, which rotate altogether while the shaft 42A rotates. The shaft 42A is in the form of elongated column extending in a lateral direction orthogonal to the conveyance direction and is made of stainless steel material, which is non-magnetic substance. To the shaft 42A, driving force is transmitted by a drive motor through a drive gear, not shown either, engaging with the drive motor. Thus, the shaft 42A can rotate about a rotational axis in both forward and reverse directions. The conveyance roller 42 rotates the plurality of annular rubber rollers 42B altogether while the shaft 42A acts.

The shaft 44 is in the form of elongated column coextending with the shaft, made of stainless steel material, which is non-magnetic substance, and is supported slidably in the directions of arrows D and E with respect to the housing 24. Moreover, the shaft 44 is biased by a spring, not shown, in the direction of arrow E. The shaft 44 is, unlike the shaft 42A, fitted non-rotatable.

Figure 4:
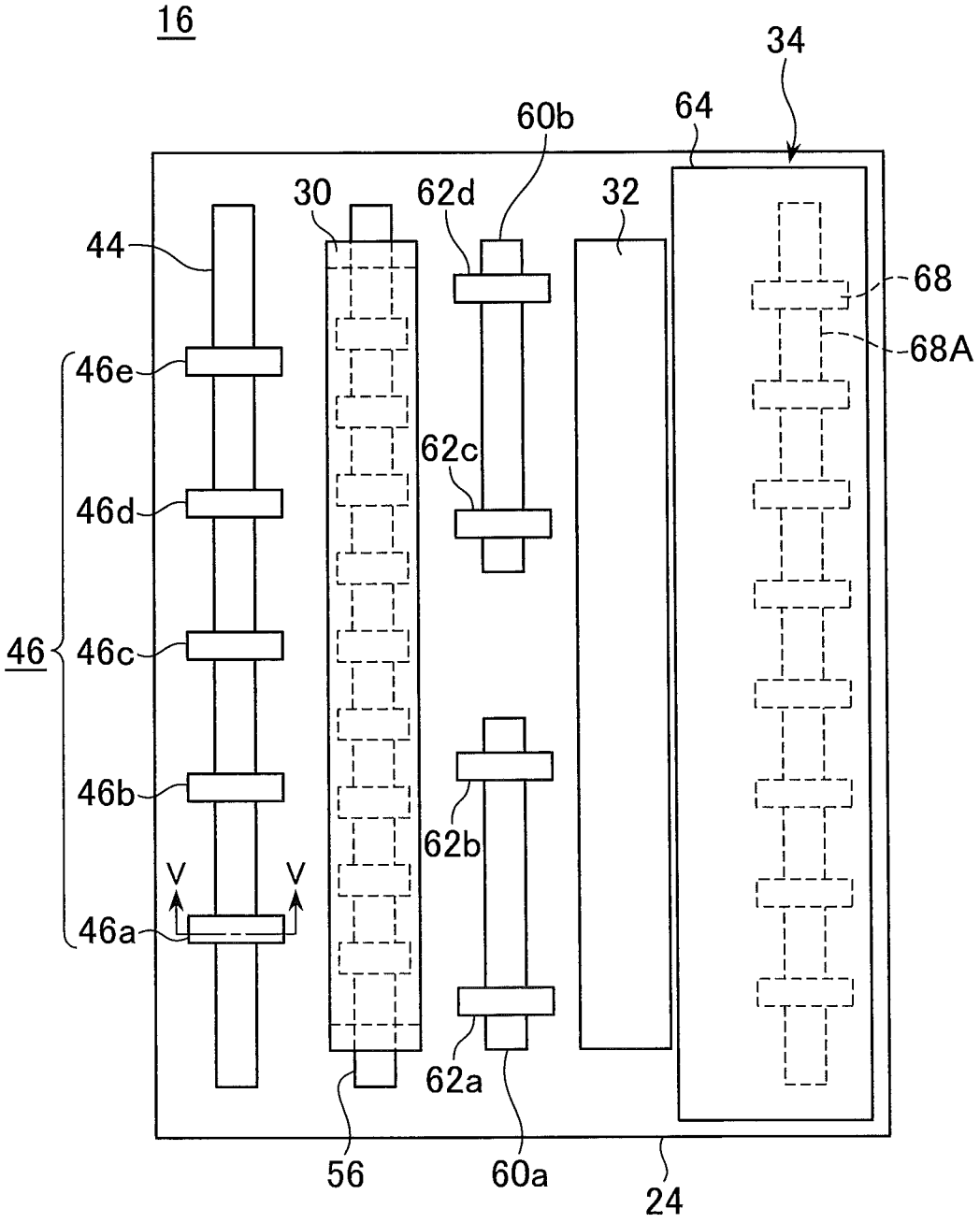
FIG. 4 is a plane view of the validator in FIG. 2 with its top panel removed, seen from above.

The tension roller 46 is generally formed into a annular shape, and has its shaft 44 penetrating through the center. The shaft 44 in FIG. 4 is held in the validator 16 to extend over at least the length of the longer side of bills. The shaft 44 is provided with five tension rollers 46*a* to 46*e* arranged at intervals. The rubber rollers 42B of the conveyance roller 42 are also disposed in positions facing the tension rollers 46*a* to 46*e*, although not illustrated in the figure.

Figure 5:
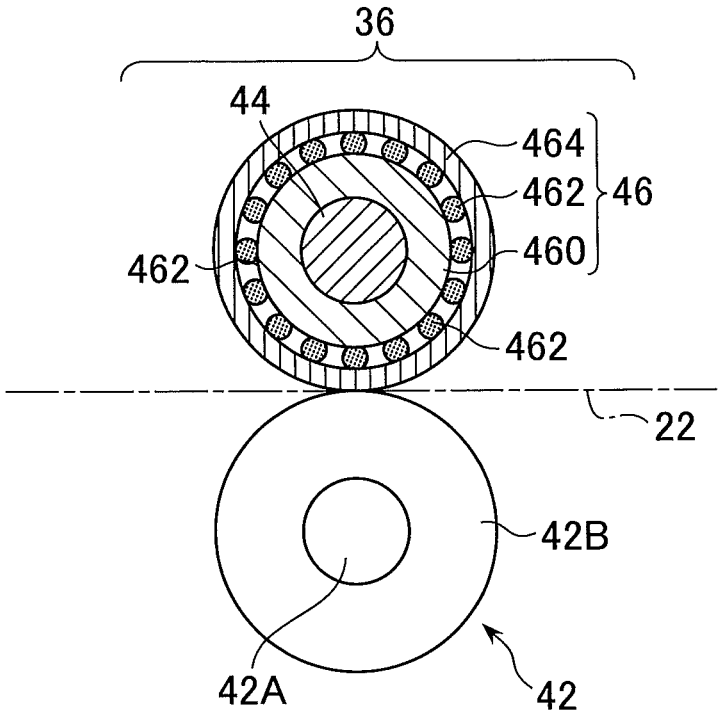
FIG. 5 is a cross-sectional and side view of one tension roller of the validator in FIG. 2 cut along a dashed-dotted line V-V in FIG. 4, in which its substantial part is enlarged, seen from the arrowed direction.

FIG. 5 illustrates, in an enlarged side view, the substantial part of the tension roller 46*a*, as a representative, in the upper unit 26 cut along the dotted line V-V in FIG. 4 viewed from the arrow direction. The tension roller 46*a* is structured by assembling an inner ring 460, a plurality of balls 462 and an outer ring 464. The balls 462 have the size thereof determined on the basis of the clearance between the inner diameter of the outer ring 464 and the outer diameter of the inner ring 460. The balls 462 serve as so-called ball bearings. All of the inner ring 460, balls 462 and outer ring 464 are made of metal material that has magnetic property. The inner ring 460 is fastened to the shaft 44.

The tension roller 46, or rollers 46*a* to 46*e*, have balls 464 having rolling resistance quite small as with a commonly-used ball bearing, so that the outer ring 464 can rotate smoothly with respect to the shaft 44 and the inner ring 460.

In the sectional conveyance path 36, when the tension roller 46 is pressed against the conveyance roller 42 to supply bills from the conveyance path 22, the outer ring 464 of the tension roller 46 is rotated smoothly so as to transmit rotational driving force of the conveyance roller 42 to the bills. The bills can be conveyed in the sectional conveyance path 36 either in the direction of arrow B or C depending on the rotational driving force thus transmitted.

1-2-2. Magnetic Detector

With reference to FIG. 3 again, the configuration of the magnetic detector 30 will now be described. The magnetic sensor 48 is disposed above the conveyance path 22 and has the function of sensing with the magnetic head 48A the magnetism in bills conveyed on the conveyance path 22 to output a sensor result to the controller 14*f*. In order to implement the function, the magnetic detector 30 includes the magnetic sensor 48, pressing members 50 and a guide roller 52. The pressing members 50 and the guide roller 52 are arranged beneath the conveyance path 22, opposing the magnetic sensor 48.

Figure 6:
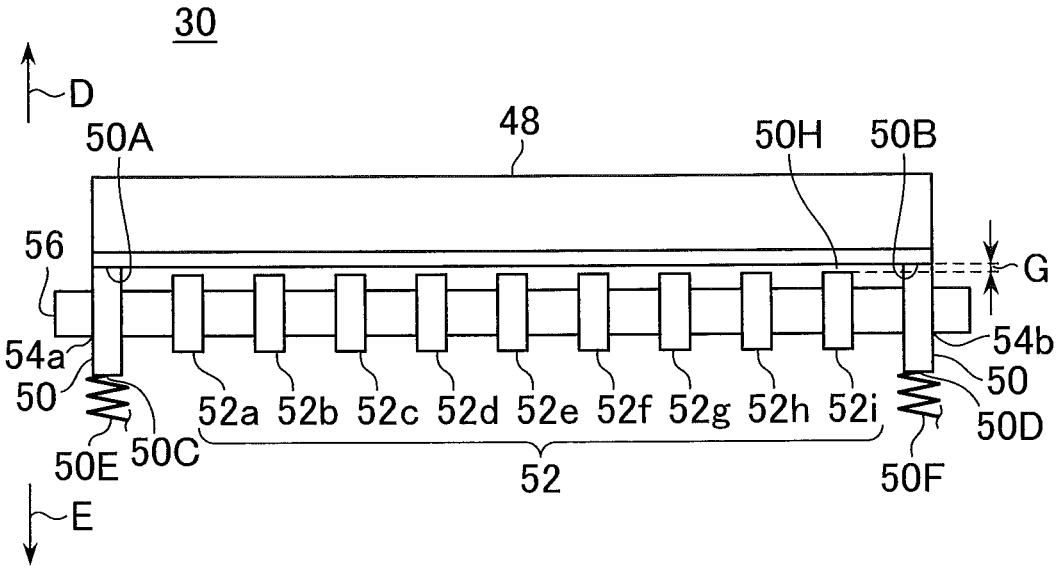
FIG. 6 is a schematic front view of a magnetic detector in FIG. 4, seen from its front side.

The magnetic detector 30 is provided with, as shown in FIGS. 4 and 6, the magnetic sensor 48 lying across the validator 16. The magnetic sensor 48 is formed into a generally cuboidal shape, and has its lower surface 48A, facing the conveyance path 22, provided with a plurality of magnetic head 48B, FIG. 3, in a direction traversing the conveyance path, i.e. the width direction.

The pressing members 50 are formed, as shown in FIG. 6, at the lower ends 50A and 50B of the magnetic sensor 48. The pressing members 50 are preferably made of a resin material formed integral with the lower ends into a thin cuboid. In addition, the pressing members 50 are supported by a frame, not shown, movably in the directions of arrows D and E, and have the lower surfaces 50C and 50D thereof respectively fitted to one ends of the springs 50E and 50F. Referring to FIG. 3 again, the spring 50E has its other end 50G fixed to the housing 24. The spring 50F also has its other end fixed to the housing 24, although not illustrated.

By that structure, the springs 50E and 50F are rendered naturally compressed by weight, so that the restoring force thereof biases the pressing members 50 toward the direction of arrow D. The pressing members 50 thus bias the upper surface of the guide roller 52 conveying bills, namely a bill contacting plane 50H, against the lower surface 48A of the magnetic sensor 48 so as to bring the bills into contact with the lower surface 48A.

In order to attain such contact brought by biasing, the pressing members 50 shown in FIG. 3 have respective through holes 54*a* and 54*b* formed at almost their centers as bearings at the opposite ends. The through holes 54*a* and 54*b* have smooth inner peripheries and serve as so-called resin bushings or resin bearings. Into the through holes 54*a* and 54*b*, inserted is a cylindrical shaft 56, as shown in FIGS. 4 and 6. The biasing force acting in the direction of arrow D is transmitted via the through holes 54*a* and 54*b* to the shaft 56.

The shaft 56 is made of stainless steel material, which is non-magnetic substance. The shaft has its outer diameter slightly smaller than the aperture diameter of the through holes 54*a* and 54*b*. The shaft 56 is configured, as with the shaft 42A, such that the driving force transmitted by the drive motor through the drive gear engaging with the drive motor, not shown either, rotates the shaft 56 in both forward and reverse directions.

The shaft 56 has a plurality of annular guide rollers 52, namely rollers 52*a* to 52*i*, inserted and fixed as with the rubber roller 46. Thus, the guide roller 52, or rollers 52*a* to 52*i*, can rotate with the shaft 56 smoothly with respect to the through holes 54*a* and 54*b*.

The pressing members 50 shown in FIG. 6 have the length and spacing thereof appropriately designed so that the guide rollers 52 have the upper ends 50H thereof positioned beneath the lower surface 48A of the magnetic sensor 48B by clearance G which is almost equal to the thickness of a single bill. In other words, the magnetic detector 30 is configured such that when the pressing members 50 come into contact with the lower surface 48A of the magnetic sensor 48B, the clearance between the lower surface 48A of the magnetic sensor 48B and the upper end 50H of the guide roller 52 will be rendered conforming to the clearance G.

That configuration allows the magnetic detector 30 to press bills with the guide rollers 52 against the lower surface 48A of the magnetic sensor 48 when the bills are conveyed on the conveyance path 22 from the front or rear side to rotate the guide roller 52 so as to follow the running bills, thereby sensing the magnetism in the bills by means of the magnetic head 48B of the magnetic sensor 48.

During the operation, the pressing members 50 renders the gap between the lower surface 48A of the magnetic sensor 48 and the upper end 50H of the guide roller 52 to conform to the clearance G, so that the height of the guide roller 52 can substantially be held in a certain level regardless of presence or absence of the bills, and therefore a vibration is hardly caused in the magnetic sensor 48.

1-2-3. Sectional Conveyance Path 38

The sectional conveyance path 38, FIG. 3, uses a conveyance roller 58 in the lower unit 28, a shaft 60 or 60*a* in the upper unit 26 and a tension roller 62, respectively corresponding to the conveyance roller 42 on the sectional conveyance path 36, the shaft 44 and the tension roller 46.

The shaft 60 is an elongate column similar to the shaft 44, but is composed of a couple of shafts 60*a* and 60*b* that are approximately half in the across-the-width length as long as the shaft 44 disposed in the lateral direction. In addition, as with the shaft 44, the shaft 60 is supported slidably in the directions of arrows D and E with respect to the housing 24, biased with the spring, not shown, in the direction of arrow E, and fitted non-rotatably.

The shafts 60, namely 60*a* and 60*b*, are provided with respective a couple of tension rollers 62, i.e. rollers 62*a*, 62*b* and rollers 62*c*, 62*d*. The tension rollers 62 are configured similarly to a so-called ball bearing as with the tension roller 46, FIG. 5.

The conveyance roller 58 is similar to the conveyance roller 42, which has the rubber roller 58B carried on the shaft 58A. The rubber roller 58B corresponds to the rubber roller 42B, but is different from the rubber roller 42B in number to be provided and position to be arranged in the width direction. As shown in FIG. 3, in the place opposite to the rubber roller 58B, a corresponding number of tension rollers 62*a* are arranged. It can be seen also from FIG. 4 that each of the tension rollers 62*a* to 62*d* is provided with rubber rollers 62*a* or the like, not shown in the figure, are arranged in the corresponding positions. It is thus understood that the lower conveyance roller 58 is also provided with four rubber rollers in total.

That configuration allows the sectional conveyance path 38, as with the sectional conveyance path 36, to press the tension roller 62 against the conveyance roller 58, and smoothly rotate, when bills are held in the conveyance path 22 which is the space between both, the outer ring of the tension roller 62 so as to transmit the rotational driving force of the conveyance roller 58 to the bills. In that way, the sectional conveyance path 38 can, as with the path 36, convey bills over the conveyance path 22 in the direction of arrow B or C.

1-2-4. Optical Detector

The optical detector 32, FIG. 3, has the function of detecting transmissive patterns of bills. The optical detector 32 includes a light emitter 32A and an optical sensor 32B for performing the above function. The light emitter 32A is arranged on the upper unit 26 side and the optical sensor 32B is on the lower unit 28 side, opposing the light emitter 32A. The light emitter 32A emits a light beam in the direction of arrow E. Part of the emitted beam transmits through a bill according to a transmissive pattern of an ink used in bills, such as a watermark on bills.

The optical sensor 32B receives a portion of the light emitted from the light emitter 32A and having passed through bills to output a result of reception to the controller 14*f*. The transmitted light represents the light transmissive pattern of bills.

In the optical detector 32 thus structured, the light emitter 32A emits light and the optical sensor 32B receives the light to thereby detect the transmissive pattern of bills, and thus a detection result can be supplied to the controller 14*f*. The light emitter 32A and the optical sensor 32B in the optical detector 32 are implemented by fastened parts, so that they can be utilized with little influence caused by changes in the surrounding magnetic field.

1-2-5. Thickness Detector

The thickness detector 34, FIG. 3, has the function of measuring the thickness of bills. The thickness detector 34 includes a housing 64, a base roller 66, a thickness detection roller 68, a bracket 70, a spring 72 and a displacement sensor 74 for implementing the above function. The thickness detector 34 is accommodated in the housing 64. As the thickness detector 34 is covered with the housing 64, its constituent elements are denoted with dashed lines in the figure. The base roller 66 is arranged in the lower unit 28 under the conveyance path 22, and the thickness detection roller 68 is arranged in the upper unit 26 above the conveyance path 22.

The base roller 66 is formed into a cylindrical shape made of metal material having magnetic property, and into the base roller 66 is inserted a generally columnar shaft 66A extending in its width direction. The shaft 66A is rotatably supported by the housing 64.

The thickness detection roller 68 is, as with the base roller 66, formed into a cylindrical shape made of metal material having magnetic property, and has a columnar shaft 68A, extending in its width direction, inserted therethrough. The thickness detection roller 68 is fitted to the bracket 70.

The bracket 70 is thinner in its thickness direction and wider in its width direction, and thus formed of elongated, thin, plate-like metal material such that the right and left ends of the straight top panel of the bracket 70 are bent in the direction of arrow E by 90 degrees to form side panels 70A. In each of the right and left side panels 70A on arrow C side, bored is a shaft hole 68B having its hole diameter such as to firmly receive the shaft 68A. Furthermore, by inserting the shaft 68A into the shaft hole 68B, the bracket 70 can rotatably hold the thickness detection roller 68 in a position nearly above the base roller 66.

The bracket 70 has a rotation hole 76 bored in a position closer to arrow B side than the position the shaft hole 68A is bored in the bent side panel 70A, and rotatably attached to the housing 64 via a small cylindrical rotational axis 78 with respect to the housing 64. That allows the bracket 70 to rotate about the rotational axis 78 so as to be able to displace the thickness detection roller 68 in the direction of D or E, i.e. vertical direction.

Furthermore, between the top panel of the bracket 70 and the top panel of the housing 64, provided is a spring 72. The spring 72 may be a coil spring. The spring 72 is fitted in such a manner that it is compressed from its natural state. When the spring 72 is put back in its natural state by the restoring force, the spring 72 pushes the housing 64 in the direction of arrow D, and thereby the top panel of the bracket 70 is pushed in the direction of arrow E. The biasing force exerted on the bracket 70 presses through the right and left side panels 70A the thickness detection roller 68 in the direction of arrow E, i.e. toward the base roller 66.

The displacement sensor 74 is arranged above the bracket 70 in the housing 64. The displacement sensor 74 refers to a position where the thickness detection roller 68 comes into contact with the base roller 66 to detect a relative amount of displacement on the top plate of the bracket 70, and in turn outputs a detection result to the controller 14*f*. The controller 14*f* refers to the detection result to determine whether the displace amount is equivalent in thickness to a single or plural bills.

In the thickness detector 34 thus structured, when no bills are conveyed over the conveyance path 22, the thickness detection roller 68 is brought into contact with the base roller 66 by the action of the spring 72. In that case, the thickness detector 34 can detect by means of the displacement sensor 74 that the bracket 70 and the thickness detection roller 68 are positioned at a reference height to supply the detection result to the controller 14*f*.

When bills are conveyed over the conveyance path 22, the thickness detection roller 68 and the base roller 66 in the thickness detector 34 hold the bills therebetween, so that the bracket 70 and the thickness detection roller 68 displace in the direction of arrow D, depending on the thickness of the bills. In that case, the thickness detector 34 detects with the displacement sensor 74 the displacement amounts of the bracket 70 and the thickness detection roller 68 to supply the detection result to the controller 14*f*.

1-3. Operation and Effects

The validator 16 of the automated teller machine 10 is provided with the pressing members 50 of the magnetic detector 30 formed of resin material as bearings for the round through hole 54*a*, into which bearings the shaft 56 of the guide roller 42 is inserted. The pressing member 50 rotatably holds the guide roller 52 by means of the bearing 54*a* through the shaft 56, thereby pressing through the guide roller 52 bills running over the conveyance path 22 against the lower surface 48A of the magnetic sensor 48.

At that time, the guide roller 52 is rotatably driven together with the shaft 56, which smoothly rotates due to the bearing 54*a* acting as resin bearing, thereby enabling to the bills be pressed against the lower surface 48A of the magnetic sensor 48 while conveying the bills. That makes it possible to keep the magnetic head 48B of the magnetic sensor 48 in contact with the running bills, so that the magnetism of the bills can stably be sensed.

In the magnetic detector 30 of the validator 16, the bore is formed particularly in the resinous pressing member 50 to form the bearing 54*a* having no rotational portions. In addition, the shaft 56 inserted into the bearing 54*a* is made of stainless steel material, which is non-magnetic.

As a consequence, changes in magnetic field which would be caused by a rotation of the guide roller 52, should the structure be composed by parts including a conventional ball bearing magnetized, can be eliminated in principle in the magnetic detector 30. That is to say, in the magnetic detector 30 of the validator 16, the guide roller 52 rotates in the immediate vicinity of the magnetic head 48B, but the rotation does not cause changes in surrounding magnetic field. Thus, the magnetic sensor 48 can sense the magnetism of the bills fairly accurately without being sensitive to noise caused by the changes in magnetic field by the magnetic head 48B.

Furthermore, since the bearing 54*a* and the shaft 56 constitute a so-called resin bearing in the magnetic detector 30, the vibration caused by rotation of the guide roller 52 can be efficiently reduced in comparison with the case of using the conventional-type ball bearing. Consequently, in the magnetic detector 30 piezonoise that would be raised by vibration in the magnetic sensor 48 can significantly be suppressed, whereby the accuracy of sensing the magnetism in bills can be improved.

Moreover, the tension roller 46 is formed as ball bearing, and thus causes rolling resistance rather than frictional resistance, so that it has high wearproof nature and can stably function over long periods of time to convey bills, whereby the maintenance working man-hours and the costs of replacing parts can be reduced.

Since a gap between the upper surface of the pressing members 50 and the upper end 50H of the guide roller 52 in the magnetic detector 30 is set to be the clearance G, which is equal to a standard thickness of a single bill, the height of the guide roller 52 will remain unchanged regardless of presence or absence of bills.

More specifically, the pressing members 50 can be arranged such that, while bills are conveyed between the guide roller 52 and the magnetic sensor 48 in the magnetic detector 30, they are nearly in contact with the lower surface 48A of the magnetic sensor 48, the pressing members 50 do not transmit vibration to the magnetic sensor 48 at all. The magnetic detector 30 can therefore reduce so-called piezonoise that would otherwise be generated during sensing the magnetism of bills.

Note that, as to the thickness detector 34 of the validator 16, the base roller 66 and the thickness detection roller 68 are formed of hardly-deformable metal material, rather than deformable resin material, in order to accurately detect the thickness of conveyed bills.

If such metallic rollers are magnetized, it may cause changes in their ambient magnetic fields during rotation, as with the conventional ball bearing. In addition, the validator 16 involves a drawback that the prevention of such changes in the magnetic field causes increase in man-hours of assembly and maintenance works to conduct an inspection task on determining magnetization and a demagnetization work when magnetization is determined.

By contrast, the optical detector 32 of the validator 16 contains no parts moving along with the conveyance of bills, as previously described, so that the magnetic field thereabout may not change. In general, it is known that the influence from a magnetic field source decreases as a distance from the source increases. Because of such characteristic, the validator 16 is provided with the optical detector 32 between the magnetic detector 30 and the thickness detector 34 in the directions of arrows B and C so as to physically insulate the detectors 30 and 34 from each other. Moreover, the optical detector 32 has magnetic material used more than a little in its housing, for example, so that it can be expected to screen the magnetism to an extent.

Thus, in the validator 16, the influence of changes in the magnetic field that is caused by the thickness detector 34 and would be exerted on the magnetic sensor 48 of the magnetic detector 30 is minimized as much as possible, thereby preventing decrease in accuracy of detecting the magnetism in the magnetic sensor 48.

As above, the magnetic detector 30 in the validator 16 of the automated teller machine 10 includes the bearing 54*a* bored in the pressing member 50 of resin material so that the bearing 54*a* rotatably holds the shaft 56 of the guide roller 52, which presses bills against the lower surface 48A of the magnetic sensor 48. Although the guide roller 52 rotates while bills run on the conveyance path 22, the rotation of the roller will not change the magnetic field around it since the bearing 54*a* includes the resin material and no moving parts and the shaft 56 includes non-magnetic material. As a consequence, in the magnetic detector 30, the guide roller 52, when rotating, causes no change in the surrounding magnetic field, and thereby the magnetic head 48B of the magnetic sensor 48 locating near the guide roller 52 can accurately sense the magnetism in bills.

In the illustrative embodiment, the pressing members 50 in the magnetic detector 30 of the validator 16 are formed of resin material, and the round through holes 54*a* and 54*b* are bored to penetrate the respective pressing members between the opposite sides thereof to be used as bearings. However, the present invention is not restricted thereto, but the pressing members 50 can be made from various materials with which bearings can be formed. Furthermore, the pressing members 50 may be made from arbitrary material, on which relatively large round through holes 54*a* and 54*b* are bored to fit annular parts into the holes 54*a* and 54*b* so as to use those parts as bearings or constitute a bearing by a combination of those parts with other parts. Such a bearing may have its inner surface smoothened so that the shaft 56 can rotate smoothly. The bearing thus configured may be sufficient to hold the shaft 56 to allow it to rotate smoothly without involving rotation of an element made of magnetic material, e.g. an outer ring of a ball bearing.

The present invention is not limited to the illustrative embodiment in which the optical detector 32 is arranged between the magnetic detector 30 and the thickness detector 34, but if it is clear that changes in magnetic field caused by the base roller 66 of the thickness detector 34 and the thickness detection roller 68 exert less influence on the magnetic sensor 48, the magnetic detector 30 and the thickness detector 34 may be arranged next to each other. The same holds true for embodiments described later.

Furthermore, the present invention is not limited to the configuration presented in the illustrative embodiment, but the apparatus of the present invention may be adapted to determine the denomination and authenticity of bills based on a magnetism detection result carried out by the magnetic detector 30, wherein the optical detector 32, the thickness detector 34, and the sectional conveyance paths 36 and 38 may be combined appropriately according to a way of the determination. The same goes for the fifth and sixth embodiments.

Second Embodiment

Next, an alternative embodiment of the automated teller machine 10 will be described. This embodiment differs only in some of the constituent elements of the validator 16, and thus the common constituent elements are indicated with the same referential numerals as in the previously described embodiment.

2-1. Configuration of the Validator

Figure 7:
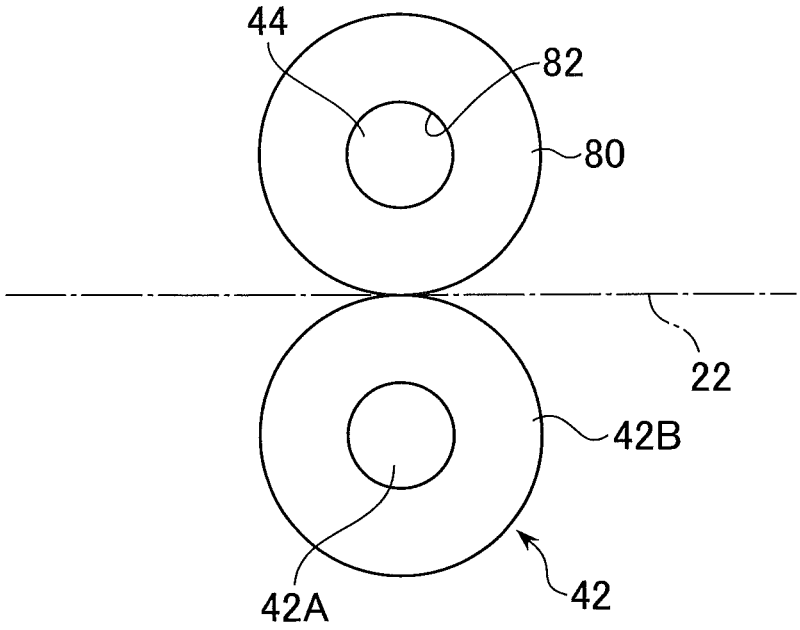
FIG. 7 is a side view showing another structure of the tension roller disposed on a sorting-conveyance path in the validator in FIG. 2.

The validator 16 has a tension roller 80 in the sectional conveyance path 36 shown, FIG. 7, which is different from the previously described embodiment. The conveyance roller 42 and the shaft 44 are formed of the same material for those shown in FIG. 5. The tension roller 80 is not the ball bearing presented in the previously described embodiment, but is made from a resin material into an annular shape. Its outer diameter is approximately equal to that of the tension roller 46*a*.

In addition, the tension roller 80 has a through hole 82 formed which has its inner diameter slightly greater than the outer diameter of the shaft 44, and of which inner periphery is smoothened. Thus, what one calls resin bearing is formed. That allows the tension roller 80, when the shaft 44 is inserted into the through hole 82, to smoothly rotate about the shaft 44. When the tension roller 62*a* in the sectional conveyance path 38 is also configured similarly to the tension roller 80, it can rotate smoothly.

In that way, in the sectional conveyance paths 36 and 38, the inner peripheries of the tension roller 80 and the tension rollers 62*a* to 62*d* function as resin bearings so as to rotate smoothly with respect to the shaft 44 and the shafts 60*a* and 60*b*.

2-2. Operation and Effects

In the validator 16 of the automated teller machine 10 in accordance with the instant embodiment, the shaft 44 presses the tension roller 80 against the conveyance roller 42 to rotatably drive the conveyance roller 42 in a rotation direction depending on a conveyance direction of bills. In practice, when bills are carried on the sectional conveyance path 36, the tension roller 80 smoothly rotates as resin bearing to transmit the rotational driving force of the conveyance roller 42 to the bills. As a consequence, the rotational driving force of the conveyance roller 42 is transmitted to the bills, and the driving force will not be reduced by the tension roller 80, so that bills will be conveyed securely with a desired speed. Since the entire tension roller 80 is made from the resin material, no parts can be magnetized, and thereby the rotation will cause no changes in the ambient magnetic field.

The tension roller 80 is simpler in structure and fewer in number of parts than the tension roller 46*a* of the ball bearing in the previously described embodiment, so that reduction can be achieved in its manufacturing costs and working man-hours of its assembling and maintenance works.

In addition, the tension rollers 62*a* to 62*d* are also made from resin material, so that the rotation of the rollers does not cause changes in ambient magnetic field. That is, although the tension rollers 80 and 62*a* are disposed closely in the directions of arrows B and C of the magnetic sensor 48 in the validator 16, the tension rollers 80 and 62*a* to 62*d* do not affect on the magnetic sensor 48 in terms of changes in magnetic fields. Accordingly, the magnetic sensor 48 can accurately sense the magnetism in bills by means of the magnetic head 48B without being affected by noise that would result from the magnetic field change.

Moreover, as with the previously described embodiment, the optical detector 32 is disposed between the magnetic detector 30 and the thickness detector 34 in the validator 16 to thereby physically isolate both of them from each other, thereby minimizing as much as possible the influence of changes in magnetic field caused by the thickness detector 34 to be exerted on the magnetic sensor 48 of the magnetic detector 30, and thus preventing decrease in accuracy of sensing the magnetism by the magnetic sensor 48.

In the above-described configuration, in the validator 16 of the automated teller machine 10, all of the tension roller 80 and the tension rollers 62*a* to 62*d* are formed of resin material in order to allow the inner peripheries of those rollers to work as resin bearings. In the validator 16, since bills are smoothly conveyed while the rotation of the tension rollers 80 and 62*a* to 62*d* does not cause changes in the surrounding magnetic fields, the magnetic head 48B of the magnetic sensor 48 is not affected by noise that would otherwise by caused by magnetic field change, so that the magnetic sensor 48 can accurately sense the magnetism in bills.

The present invention is not restricted to the embodiment in which the tension rollers 46 and 62*a* to 62*d* are formed of resin bearings, but they may be formed of non-magnetic stainless steel material, such as austenitic stainless steel material, or non-magnetic material, such as ceramics. Material to be applied may be any material that is hardly magnetized.

Furthermore, according to the present invention, at least either one of the sectional conveyance paths 36 and 38 may be sufficient to convey bills through the magnetic detector 30 on the conveyance path 22, which configuration can be adapted also in the third and fourth embodiments described later.

Third Embodiment 3-1. Configuration of the Validator

The validator 16 in a third embodiment is also different in some of the constituent elements. The tension roller 46 is configured as illustrated in FIG. 5, in which all elements are formed of non-magnetic material. The non-magnetic material used may be austenitic stainless steel material or ceramics, by way of example. Consequently, the tension roller 46 may not be magnetized, and when an outer ring 464 is rotated, no change occurs in the ambient magnetic field. The tension roller 62*a* constitutes a ball bearing with all of its inner ring, ball and outer ring made of non-magnetic material as well.

3-2. Operation and Effects

In the validator 16 thus configured, the tension roller 46*a* is pressed by the shaft 44 against the conveyance roller 42 to rotate the conveyance roller 42 in the rotation direction depending on the conveyance direction of bills. When bills are on the sectional conveyance path 36, the smooth rotation of the outer ring 464 of the ball bearing transmits the rotational driving force of the conveyance roller 42 to the bills. Thus, the driving force is not reduced by the tension roller 46*a*, and thereby the bills can be conveyed securely at a desired speed. Since non-magnetic material is used in the tension roller 46*a*, the constituent elements of the roller are not magnetized and therefore the rotation of the roller does not cause any change in the ambient magnetic field.

In addition, the tension roller 46*a* is provided with a roller acting as ball bearing, so that the rotation of the tension roller 46*a* causes rolling resistance rather than frictional resistance. Thus, the tension roller 46*a* has high wear resistance which makes the roller rotate stably over a long duration, and thereby the maintenance work man-hours and the costs of replacement parts can be reduced.

The rotation of the tension roller 62*a* of non-magnetic material does not cause change in the ambient magnetic field. Although, between the tension rollers 46*a* and 62*a*, the magnetic sensor 48 is disposed close to those rollers, it is not affected by change in the magnetic field. Thus, the magnetic head 48B does not generate noise caused by change in magnetic field, and the magnetic sensor 48 can accurately sense the magnetism of bills.

Moreover, the optical detector 32 is disposed between the magnetic detector 30 and the thickness detector 34 in the validator 16 to physically isolate both of them from each other, thereby minimizing as much as possible the influence of changes in magnetic field caused by the thickness detector 34 to be exerted on the magnetic sensor 48 of the magnetic detector 30, and thus preventing decrease in accuracy of sensing the magnetism by the magnetic sensor 48.

In the above configuration, the validator 16 implements the function of general ball bearings with the non-magnetic tension rollers 46 and 62*a* to 62*d* to convey bills smoothly, thereby preventing the ambient magnetic field from being changed when the outer rings of the tension rollers 46 and 62*a* to 62*d* are rotated. As a result, the magnetic head 48B of the magnetic sensor 48 picks up no noise that would otherwise be caused by change in magnetic field, and the magnetic sensor 48 can therefore accurately sense the magnetism of bills.

The present invention is not limited to the embodiment in which the tension rollers 46 and 62*a* to 62*d* include an inner ring 460, a ball 462 and an outer ring 464 formed of non-magnetic material, but, for instance, only the outer ring 464 or both the outer ring 464 and the ball 462 are made from the non-magnetic material so as to lessen changes in magnetic field due to the rotation.

Fourth Embodiment

4-1. Configuration of the Validator

Figure 8:
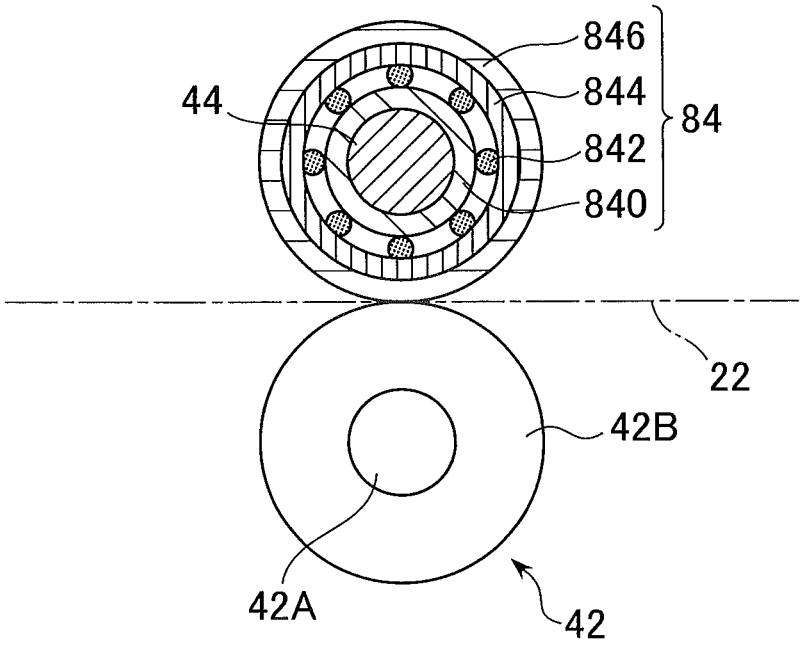
FIG. 8 is a cross-section and side view of one tension roller of the validator in FIG. 2 cut along a dashed-dotted line V-V in FIG. 4, in which its substantial part is enlarged, seen from the arrowed direction.

The validator 16 in a fourth embodiment is also different in some of the constituent elements. A tension roller 84 consists of five tension rollers 84*a* to 84*e*. FIG. 8 illustrates a cross-sectional view of the tension roller 84*a* shown in FIG. 4 cut along the break line V-V and viewed from the arrow direction. The tension roller 84*a* structurally includes an inner ring 840, balls 842, an outer ring 844 and a resin roller 846.

The inner ring 840 receives, and is fixed on, the shaft 44. The inner ring 840 has the same inner diameter as the inner ring 460 in FIG. 5, but has the outer diameter smaller than that of the inner ring 460. The outer ring 844 is smaller in inner and outer diameters than the outer ring 464. In other words, the inner ring 840, the balls 842 and the outer ring 846 of the roller 84*a* constitute a ball bearing that is equivalent in inner diameter to, but smaller in outer diameter than, the bearing of the tension roller 46.

On the exterior of the outer ring 844, the resin roller 846 made into an annular shape with resin material is fitted. The resin roller 846 has its inner diameter almost equal to the outer diameter of the outer ring 846 and its outer diameter almost equal to the outer diameter of the outer ring 464. The tension roller 84 is generally of the size almost similar to the tension roller 46, but the size as a ball bearing is smaller than that of the tension roller 46, in which the rein roller 846 of non-magnetic material covers the outer ring 844. The tension roller 84 consequently allows, by its function as ball bearing, the outer ring 844 and the rein roller 846 to smoothly rotate altogether with respect to the inner ring 840 which is fixed to the shaft 44.

The tension rollers 62*a* to 62*d* may have the same structure as the tension roller 84, not shown. With respect to the inner rings receiving, and fixed on, the shafts 60*a* and 60*b*, the outer rings and the resin rollers of the respective tension rollers 62*a*, 62*b* and rollers 62*c*, 62*d* can smoothly rotate altogether.

In that way, the tension rollers 84 and 62*a* to 62*d* are configured such that the outer diameter of each ball bearing is made small so as to rotate the outer ring and the resin roller, fitted to the outer ring, altogether.

4-2. Operation and Effects

In the above configuration, 印 the validator 16 of the fourth embodiment, the tension roller 84 is pressed to the conveyance roller 42 by means of the shaft 44 to thereby rotatably drive the conveyance roller 42 in the rotational direction according to the conveyance direction of bills. When bills are carried on the sectional conveyance path 36, the outer ring 844 and the rein roller 846 are rotated smoothly by the action of the ball bearing 842 of the tension roller 84 to thereby transmit the rotational driving force of the conveyance roller 42 to the bills. That would not cause the tension roller 84 to decrease the driving force, so that bills can be conveyed securely at a desired speed.

The tension roller 84 includes the resin roller 846 fitted on the outer periphery of the outer ring 844, and the outer diameter of the entire tension roller 84 is defined to have the same size as the tension roller 46*a*, FIG. 5. In order to implement that configuration, the outer diameter of the outer ring 844 is designed to be smaller than that of the outer ring 464, FIG. 5. In the validator 16 of the instant embodiment, a distance from the magnetic sensor 48 to the tension roller 84 is kept equal to the distance presented in the firstly described embodiment, and on the other hand a distance from the outer ring 844, which is a rotatable member of magnetic substance, to the magnetic sensor 48 can be set longer than the case of the firstly described embodiment.

Since the tension roller 84 has the function of ball bearing as with the tension roller 46*a* in the firstly described embodiment, rolling resistance is generated during rotation rather than frictional resistance, and as a consequence, the wear resistance is increased, and the outer ring 844 and the rein roller 846 can be rotated stably over long periods of time, whereby the maintenance work man-hours and the costs for replacing parts can be reduced. In the validator 16, even when a distance between the magnetic sensor 48 and the tension roller 62*a* is set to be equal to the distance defined in the firstly described embodiment, a distance from the outer ring, which is a rotatable member of magnetic substance, to the magnetic sensor 48 can be defined to be longer than that in the firstly described embodiment.

In the validator 16, the five tension rollers 84 disposed one after another on the magnetic sensor 48 and the four tension rollers 62*a* to 62*d* are arranged close to one another. Since the influence of the magnetic field changes exerted by the tension rollers 84 and 62*a* to 62*d* on the magnetic sensor 48 can be reduced, the magnetic head 48B is hardly disturbed by noise otherwise caused by changes in magnetic field, and thereby the magnetic sensor 48 can accurately sense the magnetism of bills.

Also in the validator 16 of the present embodiment, the optical detector 32 is provided between the magnetic detector 30 and the thickness detector 34 in order to physically isolate them from each other to minimize as much as possible the influence of changes of magnetic field caused by the thickness detector 34 which otherwise be exerted on the magnetic sensor 48 of the magnetic detector 30, so that the accuracy of magnetism detection in the magnetic sensor 48 can be prevented from being impaired.

In that way, the validator 16 is configured such that the outer diameter of each ball bearing in the tension rollers 84 and 62*a* to 62*d* is defined to be small, and the resin roller is mounted on the outer periphery of the outer ring so as to be able to rotate the rein roller together with the outer ring during bill conveyance. While the validator 16 is similar to the validator in the firstly described embodiment in terms of the sizes of the constituent elements, such as the outer diameter of each tension roller, as well as the layout conditions, e.g. the distance from the magnetic sensor 48 to each tension roller, the distance between the magnetic sensor 48 and the rotating member of magnetic substance is made longer. The influence of the magnetic field changes to be exerted on the magnetic head 48B of the magnetic sensor 48 can therefore be reduced, and consequently the magnetic sensor 48 can accurately sense the magnetism in bills.

Fifth Embodiment 5-1. Configuration of the Validator

Figure 9:
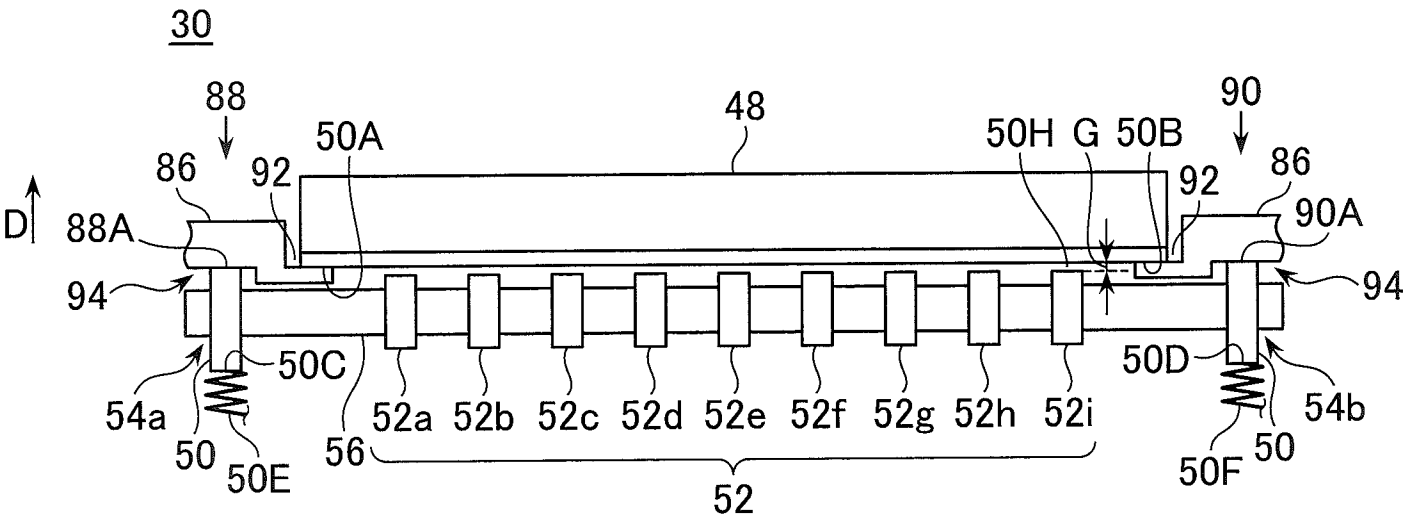
FIG. 9 is a front view schematically showing a layout relationship of a conveyance member interposed between the magnetic detector and a press member in the validator in FIG. 2.

A fifth embodiment also is different in some of the constituent elements of the validator 16. The magnetic detector 30 in the validator 16 is different from those employed in the above-described embodiments. The magnetic detector 30 has, as shown in FIG. 9, additional constituent elements, i.e. intermediate members 86.

The pressing members 50 have a generally cuboidal appearance as shown in FIG. 6 and are respectively attached directly below the ends of the magnetic sensor 48. The pressing members 50, FIG. 9, in the present embodiment are respectively located in the positions indicated by arrows 88 and 90, outer than the ends 50A and 50B on the magnetic sensor 48. The pressing members 50 have through holes 54*a* and 54*b* bored as bearings. In the bores, so-called ball bearings are embedded, and the shaft 56 is inserted. The shaft 56 in FIG. 9 is elongated to be longer than the shaft shown in FIG. 6. In addition, the shaft 56 is provided with nine guide rollers appropriately positioned. The pressing members 50 are also provided with the springs 50E and 50F on the respective lower ends 50C and 50D thereof.

In the case of FIG. 6, the pressing members 50 are located directly below the ends 50A and 50B of the magnetic sensor 48 and are biased by springs 50E and 50F, whereby bills can be conveyed without involving the adjustment according to the thickness of the bills or of the clearance. By contrast, the pressing members 50 in the instant embodiment are arranged outward beyond the magnetic sensor 48 to be farther from each other, so that the magnetic detector 30 cannot maintain the height on its own unless the thickness or the clearance is adjusted. Thus, the magnetic detector 30 of the present embodiment is provided with the intermediate members 86 interposed between the pressing members 50 and the magnetic sensor 48.

Since it is sufficient to implement a state that the pressing members 50 have one ends thereof as joined to the ends of the magnetic sensor 48, as shown in FIG. 6, the intermediate members 86 are given a crank-like shape viewed from its cross-section. The crank-like shape means that a portion coming into contact with the pressing members 50 corresponds to a crankpin and another portion coming into contact with the magnetic sensor 48 corresponds to a crankshaft, thereby configuring a crank arm jointing the crankpin to the crankshaft. The intermediate members 86 are connected to each other at their extensions extending outwardly in the lateral direction with surrounding parts which are not shown. The intermediate members 86 are made of a relatively-hard resin material, but have some elasticity.

The intermediate members 86 come into contact at their upper surfaces 92 with the lower ends 50A and 50B of the magnetic sensor 48, and at their lower surfaces 94 with the positions 88 and 90 of the pressing members 50 as well. The intermediate members 86 are formed such that the upper surfaces 92 and the lower surfaces 94 are approximately equivalent to each other in height, i.e. position in the vertical direction, of.

According to the magnetic detector 30 thus configured, the pressing members 50 can be held up in the direction of arrow D, i.e. upwardly, by means of the restoring force of the springs 50E and 50F to bring the upper surfaces 88A and 90A of the pressing members 50 into contact with the lower surfaces 94 of the intermediate members 86. In the magnetic detector 48, the restoring force of the springs 50E and 50F push upward the intermediate members 86 together with the pressing members 50 to thereby bring the upper surfaces 92 of the intermediate members 86 into contact with the lower ends 50A and 50B of the magnetic sensor 48. In the magnetic detector 30, the lower surfaces 94 and the upper surfaces 92 are aligned on almost the same level, so that, as with the firstly described embodiment, the space between the lower ends 50A and 50B of the magnetic sensor 48 and the upper ends 50H of the guide rollers 56*a* to 56*i* can conform to the clearance G, which is almost equal to the thickness of a single bill.

As above, in the magnetic sensor 30, the pressing members 50 is pressed via the intermediate members 86 against the magnetic sensor 48 to separate the guide rollers 52*a* to 52*i* from the lower ends 50A and 50B of the magnetic sensor 48 by the clearance G, and in places farther from the magnetic sensor 48 toward each end arranged are the bearings 54*a* and 54*b* of the ball bearings.

5-2. Operation and Effects

In the validator 16 thus configured, the guide rollers 52*a* to 52*i* of the magnetic sensor 48 bring bills conveyed over the conveyance path 22, FIG. 3, into contact with the lower ends 50A and 50B of the magnetic sensor 48. As the bills are conveyed, the guide rollers 52*a* to 52*i* make the inner rings of the bearings 54*a* and 54*b* of the ball bearings to rotate together with the shaft 56. Thus, if the inner rings are magnetized, the bearings 54*a* and 54*b* would change the surrounding magnetic fields while the guide rollers 52*a* to 52*i* rotate.

However, the magnetic sensor 30 is configured such that the intermediate members 86 are interposed between the magnetic sensor 48 and the pressing members 50 to separate the magnetic sensor 48 from the bearings 54*a* and 54*b* in the width direction to some extent. Consequently, with the magnetic detector 30, the influence of the magnetic field changes that would otherwise caused by the bearings 54*a* and 54*b* on the magnetic sensor 48 can be minimized, and the magnetic sensor 48 can therefore sense the magnetism of bills without being affected by noise. Moreover, since the pressing members 50 form the bearings 54*a* and 54*b* to which the ball bearings similar to those of the tension roller 46, FIG. 5, are fitted, rolling resistance, rather than frictional resistance, is generated during the rotation, whereby the endurance is increased in comparison to the case using a resin bearing.

In the magnetic sensor 30, the intermediate members 86 are interposed between the pressing members 50 and the magnetic sensor 48. As the intermediate members 86 have elasticity, when the guide rollers 52*a* to 52*i* rotating in response to the conveyance of bills cause the pressing members 50 to vibrate in the vertical direction, vibrations otherwise transmitted to the magnetic sensor 48 can be reduced or absorbed. Accordingly, the intermediate members 86 can reduce piezonoise, which may be caused by vibrations in the magnetic sensor 48, and increase the accuracy in sensing the magnetism of bills.

In the validator 16, the magnetic detector 30, the optical detector 32 and the thickness detector 34 are arranged in this order to physically separate the magnetic detector 30 and the thickness detector 34 away from each other. Thus, with the validator 16, the influence of changes in magnetic field caused by the thickness detector 34 to be exerted on the magnetic sensor 48 of the magnetic detector 30 is minimized as much as possible, thereby preventing decrease in accuracy of sensing the magnetism in the magnetic sensor 48.

According to the above configuration, the magnetic detector 30 in the validator 16 in the instant embodiment is provided with the intermediate members 86 interposed between the magnetic sensor 48 and the pressing members 50 so as to separate the bearings 54*a* and 54*b* of the ball bearings from each other toward each end and also from the magnetic sensor 48 to an extent. Consequently, with the magnetic detector 30 the influence of magnetic field changes caused by the bearings 54*a* and 54*b* on the magnetic sensor 48 can be minimized, thus allowing the magnetic sensor 48 to sense the magnetism of bills without being affected by noise.

The invention is not restricted to the embodiments in which the pressing members 50 and the intermediate members 86 are handled as separate elements and the intermediate members 86 on the opposite ends are connected to each other on the outer periphery, not shown, but can be implemented as an embodiment in which the right and left intermediate members 86 can be used independently and fixed to the housing 24 of the validator 16, or in which the intermediate members 86 are omitted and, instead, arms, not shown, can be provided, which extend from the pressing members 50 inwardly to right and left and have the function corresponding to part of the function of the intermediate members 86. Through those arms, the pressing members 50 can come into contact with the lower surface 48A of the magnetic sensor 48.

In that case, the bearings 54*a* and 54*b* are disposed on the ends of the magnetic sensor 48 on its lower side, and the clearance G is formed between the lower surface 48A of the magnetic sensor 48 and the upper ends 50H of the guide roller 52*a* to 52*i*. In that situation, vibrations caused on the pressing members 50 by the rotation of the guide rollers 52*a* to 52*i* are preferably reduced or absorbed by the intermediate members 86 or the above-described arms, not shown.

In addition, the present invention is not limited to the embodiments in which the bearings 54*a* and 54*b* are embedded as ball bearings in the pressing members 50, but alternatively, as with the firstly described embodiment, the through holes formed of resin material can be utilized to configure bearings as resin bearings, or as with the tension roller 46 and others in the third embodiment, the ball bearings made of non-magnetic material may be embedded.

Furthermore, the present invention is not restricted to the first and fifth embodiments, in which the clearance G equivalent to the thickness of a single bill is provided between the lower surface 48A of the magnetic sensor 48 and the upper ends 50H of the guide rollers 52*a* to 52*i*, but alternatively a desired gap can be formed between the lower surface 48A of the magnetic sensor 48 and the upper ends 50H of the guide rollers 52*a* to 52*i*, or the upper ends 50H of the guide rollers 52*a* to 52*i* can be made such as to come into contact with the lower surface 48A of the magnetic sensor 48. In that case, against the lower surface 48A of the magnetic sensor 48, bills are preferably pressed by the guide rollers 52*a* to 52*i* to be conveyed.

Sixth Embodiment

6-1. Configuration of the Validator

Figure 10:
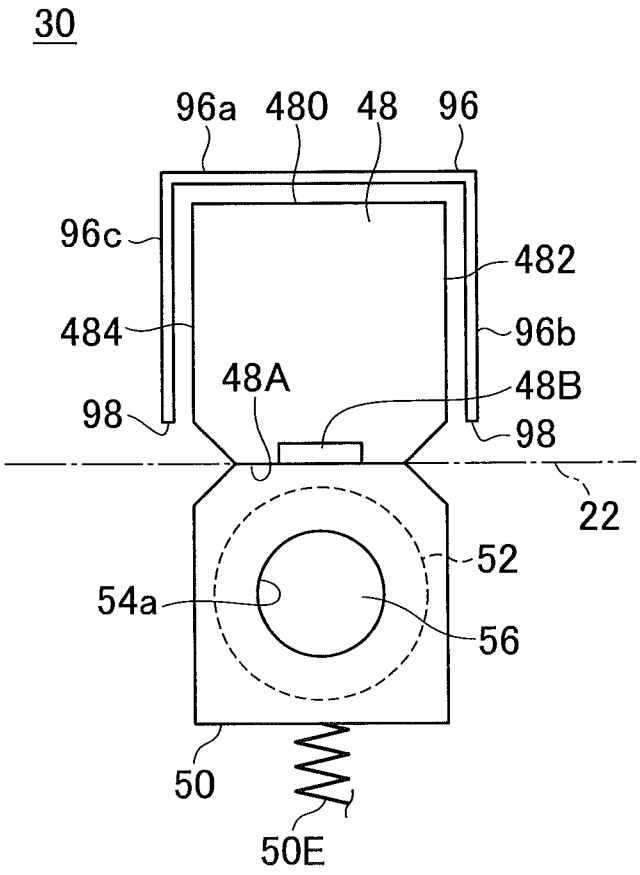
FIG. 10 is a schematic side view showing the magnetic detector in FIG. 3 as being covered with a magnetic shield plate.

The validator 16 in the instant embodiment is also different in some of its constituent elements. The magnetic detector 30 is different only in its constituent elements. In the present embodiment, the magnetic detector 30 has, as shown in FIG. 10, a magnetic shield plate 96, consisting of 96*a*, 96*b* and 96*c*, arranged near the magnetic sensor 48. The magnetic shield plate 96 is implemented by material having capability of blocking off or significantly decreasing magnetism. The magnetic shield plate 96 is formed in such a way that one shield plate, for instance, is bent downwardly at its two points, which are the corners of the magnetic sensor 48 so as to cover an upper surface 480, a front surface 482 and a back surface 484 of the magnetic sensor 48. Accordingly, the magnetic shield plate 96 is formed by a thin plate slightly larger than the magnetic sensor 48. The magnetic shield plate 96 covers the magnetic sensor 48 to function as a top panel 96*a*, a front panel 96*b* and a back panel 96*c*.

The lower ends 98 on the front panel 96*b* and the back panel 96*c* of the magnetic shield plate 96 are positioned slightly above the lower surface 48A of the magnetic sensor 48 so as to secure the conveyance path 22 to prevent bill conveyance from being interfered.

In that way, the magnetic sensor 48 has its three surf aces except both side surfaces, i.e. the upper surface 480, the front surface 482 and the back surface 484, enclosed by the magnetic shield plate 96. Thus, the magnetic shield plate 96 can eliminate, or significantly reduce, the influence of the magnetic field changes exerted from the three directions of the magnetic sensor 48.

6-2. Operation and Effects

In the above-described configuration, the magnetic sensor 30 in the validator 16 in the sixth embodiment is provided with the magnetic shield plate 96, or 96*a*, 96*b* and 96*c*, arranged to cover three surfaces 480, 482 and 484 of the magnetic sensor 48, except both sides thereof. The tension rollers 46 and 62*a* to 62*d* are arranged in the vicinity of the magnetic sensor 48 such that they rotate in response to the bill conveyance. If the outer rings 464 of the tension rollers 46 and 62*a* to 62*d* are magnetized, they would induce changes in the surrounding magnetic field anytime while rotating.

In the magnetic detector 30, however, the magnetic shield plate 96 can shut off or significantly reduce the magnetism coming from the three directions of the magnetic sensor 48. Consequently, noise due to magnetic field changes caused by nearby tension rollers 46 and 62*a* to 62*d* is not caught or drastically decreased in level of noise detection, whereby the magnetic sensor 48 can accurately sense the magnetism of bills.

Seeing this from another perspective, as the tension rollers 46 and 62*a* to 62*d* of the validator 16 are formed of magnetic material, the rollers can be utilized as ball bearings, whereby the endurance can be more enhanced than the case of using resin bearings. In addition, most of the elements inside the automated teller machine 10, which are sources of magnetic noise, e.g. the motor for conveying bills over the conveyance path 22, the solenoid for switching the conveyance path 22, or various cooling fans, although not shown, are disposed above the conveyance path 22 of the validator 16. In the magnetic detector 30, the influence of magnetic field changes caused by such sources of magnetic noise can be eliminated or reduced significantly by means of the magnetic shield plate 96, thereby allowing the magnetic sensor 48 to accurately sense the magnetism of bills.

In addition, the optical detector 32 is arranged between the magnetic detector 30 and the thickness detector 34 to isolate the detectors 30 and 32 from each other, thereby minimizing as much as possible the influence of changes in magnetic field caused by the thickness detector 34 to be exerted on the magnetic sensor 48 of the magnetic detector 30, and thus preventing decrease in accuracy of the magnetic sensor 48 in sensing the magnetism.

In that configuration, since the magnetic sensor 48 is covered with the magnetic shield plate 96 from the three directions in the magnetic sensor 30 of the current embodiment, even when the rotation of the tension rollers 46 and 62*a* to 62*d* disposed near the magnetic sensor 48 in its front and back induce changes in the ambient magnetic fields, the magnetic shield plate 96 can block off or greatly reduce the influence of the magnetic field changes. Accordingly, the magnetic sensor 48 is insensitive to noise caused by changes in the ambient magnetic field or can significantly lower its detection threshold, thereby attaining an accurately detection of the magnetism in bills.

Figure 11:
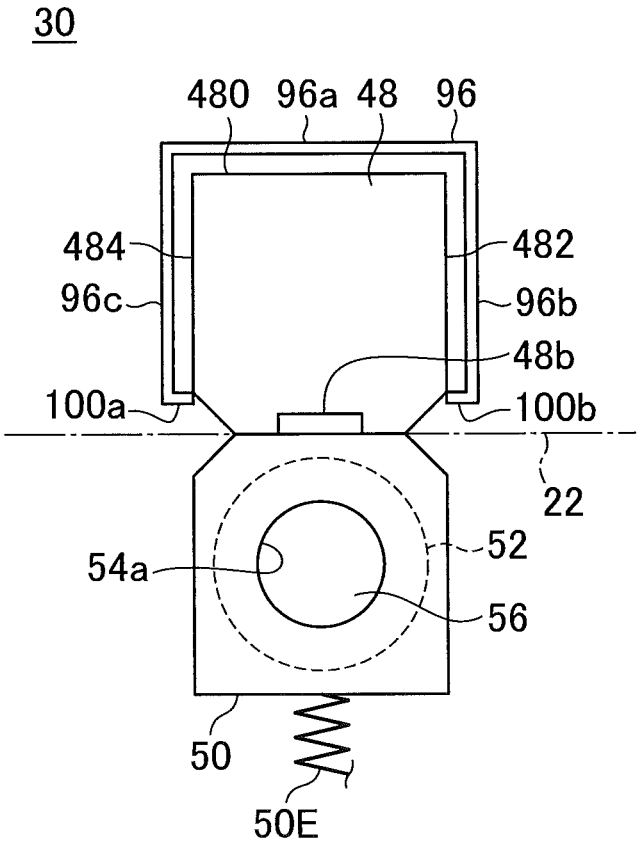
FIG. 11 is a schematic side view showing the magnetic detector in FIG. 3 as being covered with an alternative embodiment of magnetic shield plate.

The present invention is not limited to the embodiment in which the magnetic shield plate 96 covers the three surfaces 480, 482 and 484 of the magnetic sensor 48, but, as shown in FIG. 11, the magnetic detector 30 may be provided with the magnetic shield plate 96. The magnetic shield plate 96 is bent at the front panel 482 side and the back panel 484 side toward the magnetic sensor 48 side, i.e. to the back and front directions, such that the bent portions extend in the form of lower plates 100*a* and 100*b*. The magnetic shield plate 96 in FIG. 11 has a shielding effect on the magnetism in the magnetic sensor 48 higher than the effect provided by the configuration in FIG. 10. Thus, the magnetic shield plate 96 can further reduce the influence exerted on the magnetic sensor 48 by changes in magnetic field surrounding the magnetic sensor 48.

The present invention is also not limited to the embodiment in which the magnetic shield plate 96 is arranged to cover the magnetic sensor 48 from above, front and back, i.e. from outside, but can be adapted to incorporate the magnetic shield plate in the magnetic sensor 48, although not illustrated.

Moreover, the present invention is not restricted to the embodiment in which the magnetic shield plate 96 is composed of the top panel 96*a*, the front panel 96*b* and the back panel 96*c* respectively locating in the three direction of the magnetic sensor 48, namely from above, front and back of the sensor. Alternatively, if it is sure that the influence of magnetic field changes exerted from above is small, the top panel 96*a* can be omitted, and only the front panel 96*b* and the back panel 96*c* or only the surfaces and the sides thereof can be covered with the magnetic shield plate 96. In that case, the magnetic shield plate 96 may be placed in the directions, with respect to the magnetic sensor 48, where parts predominantly affecting magnetization reside and bills are not prevented from being conveyed.

The present invention is not limited to the above embodiments where the magnetic sensor 30, and the sectional conveyance paths 36 and 38 are arranged alone, but those may be provided in an arbitrary combination. As an example of such combination, the pressing members 50 of the firstly described embodiment may be combined with the tension rollers 46 and 62*a* to 62*d* of the second embodiment, or those constituent elements may be combined with the magnetic shield plate 96 of the sixth embodiment. Moreover, the pressing members 50 and the intermediate members 86 of the fifth embodiment may be combined to the tension rollers 46 and 62*a* to 62*d* of the fourth embodiment. Those combinations implement the validator 16 synergistically reducing the influence of ambient magnetic field changes on the magnetic sensor 48, thereby efficiently improving the accuracy of sensing the magnetism of bills.

The entire disclosure of Japanese patent application No. 2011-207805 filed on Sep. 22, 2011, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

INDUSTRIAL APPLICABILITY

It is clarified that the present invention can be applied to a variety of medium validating apparatuses, which sense the magnetism of a magnetic medium while being conveyed for validation.

The present invention is not restricted to the embodiments of validating processing of bills as media, but can be applied to an apparatus for validating media, such as gift vouchers, cash vouchers, admission tickets or various magnetic forms of magnetic cards. In such cases, apparatuses applied may have the conveyance path thereof appropriately designed depending on the shapes of media.

The invention claimed is:

1. A medium validating apparatus comprising:

a magnetic detector detecting magnetism of a supplied medium; and a validation controller validating the medium based on a result of magnetism detection conducted by said magnetic detector;

wherein said magnetic detector includes:

a magnetic sensor sensing magnetism by a magnetic head;

a guide roller disposed near the magnetic head and rotating while being in contact with the medium so as to convey the medium with the medium contacting the magnetic head, said guide roller having a rotation shaft;

a bearing supporting said rotation shaft;

a pressing member in which said bearing is embedded; and an intermediate member interposed between the magnetic head and said pressing member and separating the magnetic head and said guide roller from each other by a distance corresponding to a thickness of the medium;

wherein said guide roller is disposed inward of both ends of said magnetic sensor in a longitudinal direction of said magnetic sensor; and wherein said pressing member is disposed outward of the both ends of said magnetic sensor in the longitudinal direction of said magnetic sensor.

2. The apparatus in accordance with claim 1, wherein said intermediate member has elasticity.

3. The apparatus in accordance with claim 1, further comprising:

a conveyance roller disposed in a vicinity of said magnetic detector to rotate about a rotational axis to thereby convey the medium; and a tension roller disposed opposite to said conveyance roller across a conveyance path for the medium to rotate in response to rotation of said conveyance roller to transmit rotational driving force of said conveyance roller to the medium, wherein a bearing of said tension roller has a part that rotates together with said tension roller and is made of non-magnetic material.

4. The apparatus in accordance with claim 3, wherein:

said tension roller is formed into a circular shape with non-magnetic material; and the bearing of said tension roller forms an inner periphery of said tension roller to rotatably hold said tension roller with respect to a rotational axis.

5. The apparatus in accordance with claim 3, wherein said tension roller serves as a ball bearing, and has at least an outer ring made of non-magnetic material.

6. The apparatus in accordance with claim 1, wherein said magnetic detector is provided in its vicinity with a magnetic shield plate blocking off the magnetism.

7. The apparatus in accordance with claim 6, wherein said magnetic shield plate is formed to cover a circumferential side surface of said magnetic detector except for a surface on which the magnetic head is disposed.

8. The apparatus in accordance with claim 7, wherein said magnetic shield plate is formed to cover, in addition to the circumferential side surface, part of the surface carrying the magnetic head, the part being in the vicinity of the magnetic head.

9. The apparatus in accordance with claim 1, further comprising:

an optical detector having no movable magnetic part for emitting light to the medium and receiving light having passed the medium; and a thickness detector detecting a thickness of the medium based on an amount of displacement of a thickness detection roller having magnetic material, said thickness detector being positioned opposite to said magnetic detector with respect to said optical detector.

10. A medium transaction apparatus comprising:

a receiving section accepting a transaction relating to a medium;

a conveyance path conveying the medium received;

a magnetic detector using a magnetic head to detect magnetism of the medium conveyed over said conveyance path; and a validation controller validating the medium based on a result of magnetism detection conducted by said magnetic detector;

wherein said magnetic detector includes:

a guide roller disposed near the magnetic head and rotating while being in contact with the medium so as to convey the medium with the medium contacting the magnetic head, said guide roller having a rotation shaft;

a bearing supporting said rotation shaft;

a pressing member in which said bearing is embedded; and an intermediate member interposed between the magnetic head and said pressing member and separating the magnetic head and said guide roller from each other by a distance corresponding to a thickness of the medium;

wherein said guide roller is disposed inward of both ends of said magnetic sensor in a longitudinal direction of said magnetic sensor; and wherein said pressing member is disposed outward of the both ends of said magnetic sensor in the longitudinal direction of said magnetic sensor.

11. The apparatus in accordance with claim 10, wherein:

in a vicinity of said magnetic detector, there is provided a magnetic shield plate blocking off the magnetism, said magnetic shield plate being formed to cover a circumferential side surface of said magnetic detector except for a surface on which the magnetic head is disposed; and said conveyance path includes a conveyance roller conveying the medium by a rotating part including magnetic material, said conveyance roller being positioned opposite to the magnetic head of said magnetic detector with respect to said magnetic shield plate.

12. A medium validating apparatus comprising:

a magnetic detector using a magnetic head to detect magnetism from a medium;

a thickness detector detecting a thickness of the medium based on an amount of displacement of a thickness detection roller having magnetic material;

a conveyance roller disposed between said magnetic detector and said thickness detector and rotating about a rotational axis to thereby convey the medium;

a tension roller disposed opposite to said conveyance roller across a conveyance path for the medium and rotating in response to rotation of said conveyance roller to transmit rotational driving force of said conveyance roller to the medium; and a validation controller validating the medium based on a result of magnetism detection conducted by the magnetic head;

wherein said magnetic detector includes:

an annular guide roller disposed near the magnetic head and rotating while being in contact with the medium so as to convey the medium with the medium contacting the magnetic head, said guide roller having a rotation shaft;

a bearing attached as a ball bearing of magnetic material on an inner periphery of said guide roller to rotatably support said rotation shaft;

a pressing member in which said bearing is embedded; and an intermediate member interposed between the magnetic head and said pressing member and separating the magnetic head and said guide roller from each other by a distance corresponding to a thickness of the medium;

wherein said guide roller is disposed inward of both ends of said magnetic sensor in a longitudinal direction of said magnetic sensor; and wherein said pressing member is disposed outward of the both ends of said magnetic sensor in the longitudinal direction of said magnetic sensor.

13. The apparatus in accordance with claim 12, further comprising an optical detector disposed between said magnetic detector and said thickness detector to emit light to the medium and receive light having passed the medium, said optical detector including no movable magnetic part.

* * * * *